US010517442B2

(12) United States Patent
Taylor

(10) Patent No.: US 10,517,442 B2
(45) Date of Patent: Dec. 31, 2019

(54) CLOTH TOWEL HANGER FOR USE WITH A PAPER TOWEL DISPENSER

(71) Applicant: Lidia M. Taylor, El Centro, CA (US)

(72) Inventor: Lidia M. Taylor, El Centro, CA (US)

( * ) Notice: Subject to any disclaimer, the term of this patent is extended or adjusted under 35 U.S.C. 154(b) by 284 days.

(21) Appl. No.: 15/422,754

(22) Filed: Feb. 2, 2017

(65) Prior Publication Data

US 2018/0213982 A1 Aug. 2, 2018
US 2019/0021554 A9 Jan. 24, 2019

(51) Int. Cl.
*A47K 10/22* (2006.01)
*A47K 10/38* (2006.01)

(52) U.S. Cl.
CPC ..... *A47K 10/22* (2013.01); *A47K 2010/389* (2013.01)

(58) Field of Classification Search
CPC ..... A47K 10/22; A47K 10/3836; A47K 2010/389; A47L 17/00
See application file for complete search history.

(56) References Cited

U.S. PATENT DOCUMENTS 3,018,490 A * 1/1962 Eichorst ..... A47K 1/02 126/30
4,497,077 A * 2/1985 Provost ..... A47K 1/02 248/156
6,619,582 B1 * 9/2003 Jørgensen ..... A47K 10/3836 242/422.5
6,988,691 B1 * 1/2006 Lai ..... A47K 10/38 242/594
7,025,302 B1 * 4/2006 Morkovsky ..... D05B 43/00 242/129.72
7,278,604 B1 * 10/2007 Constantino ..... A47K 10/38 242/403
8,282,034 B1 * 10/2012 Channel ..... A47K 10/38 242/597.3
8,973,859 B2 * 3/2015 Troncoso ..... D05B 43/00 242/129.72
2002/0130211 A1 * 9/2002 Kerr ..... A47K 10/3836 242/422.5
2005/0127229 A1 * 6/2005 Patterson ..... A47K 10/3836 242/422.5
2008/0061186 A1 * 3/2008 Nip ..... A47K 10/3836 242/597.7
2017/0319019 A1 * 11/2017 Simmons ..... A47K 10/3836

* cited by examiner

*Primary Examiner* — William A. Rivera
(74) *Attorney, Agent, or Firm* — Nydegger & Associates

(57) ABSTRACT

The present invention is a device for simultaneously holding a roll of paper towels adjacent to a cloth towel hanger. Structurally, a support is provided for holding the roll of paper towels in an upright orientation, and a cloth towel hanger is provided which interacts directly with the support. For this combination, an extension unit includes an upper rod with the cloth towel hanger. This upper rod is pivotally engaged with a lower rod for rotation about a pivot point. In one configuration, both rods of the extension unit are aligned for insertion into the lumen of the support. In an angled configuration, the extension unit is partially withdrawn from the support, and the upper rod is rotated about the pivot point to project the hanger radially from the support for a joint use of the hanger with the paper towel holder.

8 Claims, 2 Drawing Sheets

CLOTH TOWEL HANGER FOR USE WITH A PAPER TOWEL DISPENSER

FIELD OF THE INVENTION

The present invention pertains generally to towel holders. In particular, the present invention pertains to a unitary device for simultaneously holding both a roll of paper towels and for hanging a cloth hand/dish towel adjacent to the paper towels. The present invention is particularly, but not exclusively, useful as a paper towel holder which can be easily reconfigured for either replacing rolls of paper towels, or for joint use of paper towels with a cloth hand/dish towel.

BACKGROUND OF THE INVENTION

Under any circumstances, kitchen clean-up is always somewhat problematic. This is especially so during and after food preparation. Invariably, at some time or times in the process, the use of a towel is required.

Although paper towels can be useful for certain tasks, and can be easily discarded after use, there are still many kitchen clean-up tasks for which the use of a cloth towel is preferable. Most often, however, both paper towels and cloth towels may need to be used. Consequently, a convenient location in the kitchen where a paper towel and/or a cloth towel can be obtained for a respectively particular task is desirable.

With the above in mind, it is an object of the present invention to provide a device for holding towels which conveniently holds both paper towels and cloth towels at a same location where either type towel can be easily obtained for any particular clean-up job in a kitchen. Another object of the present invention is to provide a device for holding towels which can be easily reconfigured between a stand-alone paper towel holder and a joint paper/cloth towel holder. Still another object of the present invention is to provide a device for holding towels that is conveniently easy to use, is simple to manufacture, and is cost effective.

SUMMARY OF THE INVENTION

In accordance with the present invention, a device is provided which can simultaneously hold a roll of paper towels and provide a hanger for a cloth hand/dish towel. In general, the device includes a support which will hold a roll of paper towels in an upright orientation. And, in combination with the paper towel holder, the device includes an extension unit which interacts with the support to provide a cloth hand/dish towel hanger.

Structurally, the device of the present invention includes a tubular support which defines an axis and has a lumen that extends along the axis between the ends of the support. The tubular support has a length H and an outside diameter $d_o$, and the lumen of the support has an inside diameter $d_i$. For purposes of the present invention, the support is mounted on a base for holding a roll of paper towels upright on the base.

In addition to the tubular support, the device of the present invention also includes an extension unit which comprises an upper rod in combination with a lower rod. Both the upper rod and the lower rod are straight. The upper rod has a length $L_u$ with a diameter $d_r$. Further, a hanger is attached to one end of the upper rod, and a prong with a length s is formed to extend from the other end of the upper rod. On the other hand, the lower rod has a length $L_L$, which is preferably longer than $L_u$. Its diameter $d_r$, however, is the same as that of the upper rod. One end of the lower rod is formed with a pair of parallel opposed tines for receiving the prong of the upper rod therebetween. With this engagement the extension unit is provided with a pivot point that is located between the upper and lower rods.

In an operation of the device of the present invention, the extension unit is reconfigurable by a relative rotation of the upper rod and the lower rod about the pivot point. Specifically, this reconfiguration is between a straight configuration and an angled configuration. In the straight configuration the upper rod is aligned with the lower rod for their insertion together into the lumen of the support. In the angled configuration, the lower rod remains in the lumen of the support and the upper rod is withdrawn from the lumen. Once the upper rod has been withdrawn from the lumen of the support, the upper rod can be rotated about the pivot point through an angle θ to thereby radially extend the upper rod perpendicular to the axis of the support. With this relative rotation, the hanger on the upper rod is oriented at the length $L_u$ from the axis of the support for hanging a cloth towel therefrom. At the same time, the lower rod will remain inside the lumen of the support to stabilize the upper rod in its radially extended orientation.

Several interactive dimensions of components for the present invention are particularly noteworthy. For instance, the base on which the support is mounted is preferably circular and has a radius R. In this case, the length of the upper rod $L_u$ is greater than R ($L_u$>R) so that when the upper rod is rotated through an angle θ (θ=90°) for an angled configuration of the extension unit, a cloth towel can hang clear of any contact with a roll of paper towels being held on the support. Also, in order for the extension unit to be received inside the lumen of the tubular support, the length of the upper rod $L_u$, plus the length of the lower rod $L_L$, is preferably less than the length H of the support ($L_U+L_L<H$). Further, for this same purpose, the diameters $d_r$ of both the upper rod and the lower rod must be less than the inside diameter $d_i$ of the lumen ($d_r<d_i$). Additionally, so that the upper rod can be supported in the angled configuration of the extension unit, the length s of the prong on the upper rod is preferably less than half the inside diameter $d_i/2$ of the lumen ($s<d_i/2$).

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
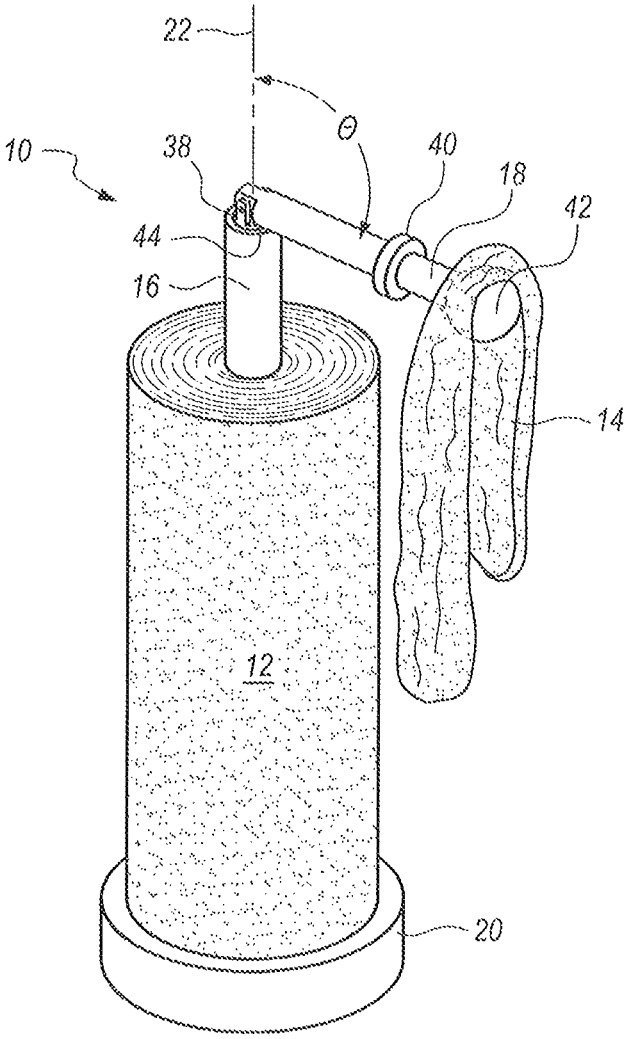
FIG. 1 is a perspective view of a device in accordance with the present invention, wherein the device is configured for simultaneous use in holding a roll of paper towels and hanging a cloth hand/dish towel.

Referring initially to FIG. 1, a device for holding towels in accordance with the present invention is shown and is generally designated 10. As shown the device 10 is specifically intended to simultaneously hold both a roll of paper towels 12 and at least one cloth hand/dish towel 14. For this purpose, the device 10 includes a tubular support 16 for holding the roll of paper towels 12 in an upright orientation, and a hanger 18 which can be selectively extended radially from the support 16 for holding a cloth towel 14.

Figure 2:
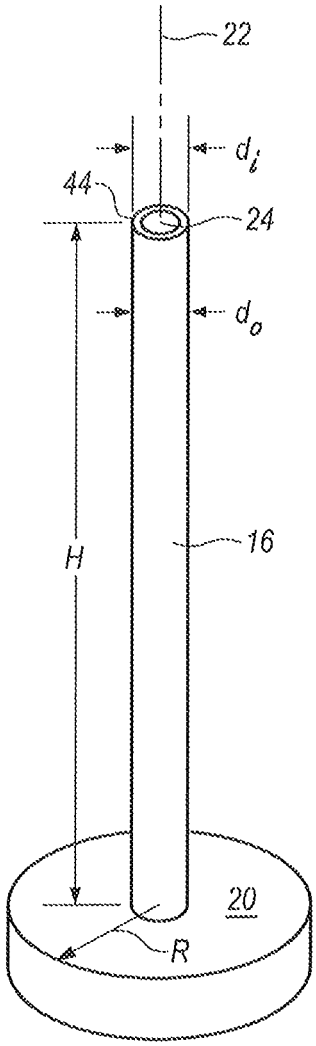
FIG. 2 is a perspective view of a support used for the present invention.

Structurally, FIG. 2 shows that the straight, tubular support 16 is mounted on a circular base 20 having a radius R. Further, FIG. 2 shows that the tubular support 16 defines a longitudinal axis 22, and that it is formed with a lumen 24 which extends along the entire length H of the support 16. Also, the support 16 has an outside diameter $d_o$, and the lumen 24 has an inside diameter $d_i$.

Figure 3:
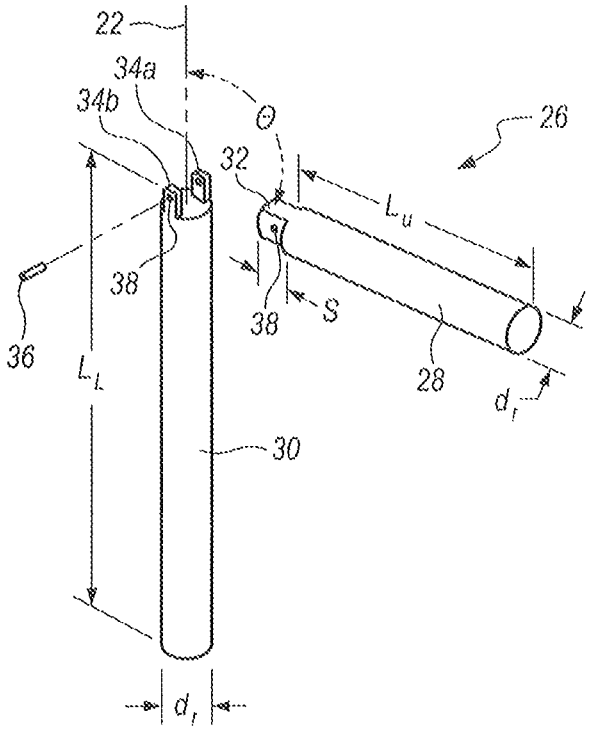
FIG. 3 is an exploded perspective view of an extension unit for the present invention, with the extension unit presented in its angled configuration.

Turning now to FIG. 3 an extension unit in accordance with the present invention is shown and is generally designated 26. As shown, the extension unit 26 includes both an upper rod 28 and a lower rod 30. In detail, the upper rod 28 is preferably cylindrical, and it has a length $L_U$, which is preferably equal to or greater than R of the base 20. The upper rod 28 has a diameter $d_r$. Also, the upper rod 28 is formed with a prong 32 that extends through a distance s from one end of the upper rod 28. The lower rod 30 of the extension unit 26, like the upper rod 28, is preferably cylindrical. Unlike the upper rod 28, however, the lower rod 30 has a length $L_L$. Preferably $L_L$ is longer than $L_u$ of the upper rod 28, although the diameter $d_r$ of the lower rod 30 is the same as for the upper rod 28. Further, extending from one end of the lower rod 30 are a pair of tines 34*a* and 34*b*. The tines 34*a* and 34*b* are parallel and opposite each other.

In combination, the prong 32 of the upper rod 28 is positioned between the tines 34*a* and 34*b* of the lower rod 30. A pin 36 is then inserted through respective holes in the prong 32 of upper rod 28 and in the tines 34*a* and 34*b* of the lower rod 30 to establish a pivot point 38 for the extension unit 26. Functionally, the pivot point 38 allows the extension unit 26 to be reconfigured between a straight configuration and an angled configuration. When in its straight configuration, the upper rod 28 of the extension unit 26 is aligned with the lower rod 30 along the axis 22 for insertion of the extension unit 26 into the lumen 24 of the support 16. On the other hand, for the angled configuration of the extension unit 26, the upper rod 28 is withdrawn from the lumen 24 of the support 16 and is rotated about the pivot point 38 through an angle θ from the axis 22. FIG. 3 provides a generalized (i.e. disconnected) view of the extension unit 26 in its angled configuration.

Figure 4:
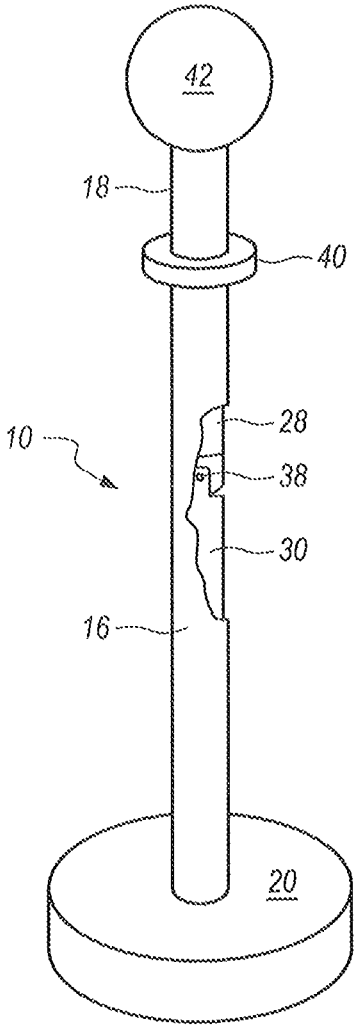
FIG. 4 is a perspective view of the device of the present invention with portions broken away for clarity, wherein the support and the extension unit are shown together in combination, with the extension unit in its straight configuration and positioned inside the lumen of the support.

Returning for the moment to FIG. 1 it is to be appreciated that the hanger 18 is affixed to the extension unit 26. Specifically, the hanger 18 includes an abutment 40 and a knob 42. In this combination, the abutment 40 is attached to the end of upper rod 28 that is opposite the pivot point 38. With this in mind, FIG. 4 shows the device 10 of the present invention, without either the roll of paper towels 12 or the cloth hand/dish towel 14. With reference to FIG. 4, it is to be appreciated that the extension unit 26 will necessarily be confined in its straight configuration when it is positioned in the lumen 24 of the support 16. As intended for the present invention, the knob 42 can be any sort of ornamental feature that may be desired.

In an operation of the present invention, the device 10 will initially be configured as shown in FIG. 4. The extension unit 26 can then be withdrawn completely from the lumen 24 of support 16, and a roll of paper towels 12 can be positioned on the support 16 as shown in FIG. 1. With the roll of paper towels 12 on the support 16, the extension unit 26 can be repositioned inside the lumen 24 as shown in FIG. 4.

FIG. 1 shows that while a roll of paper towels 12 remains on the support 16, the extension unit 26 can be partially withdrawn from the lumen 24 until the pivot point 38 has emerged from the lumen 24. At that point, the extension unit 26 can be reconfigured from its straight configuration and into its angled configuration as shown in FIG. 1. Specifically, in the angled configuration for the extension unit 26, the upper rod 28 is rotated through the angle θ (e.g. θ=90°) until contact is established between the upper rod 28 and the lip 44 of support 16. As intended for the present invention, the interaction inside the lumen 24 between support 16 and the lower rod 30, together with the contact interaction between the upper rod 28 and lip 44 of the support 16, hold the extension unit 26 in its angled configuration. It is in this angled configuration that the device 10 of the present invention can simultaneously hold a roll of paper towels 12 together with a cloth hand/dish towel 14.

In review, interactive dimensions of components for the device 10 are important for various functional reasons. In particular, the length $L_u$ of the upper rod 28 should be greater than R ($L_u$>R) so that when the upper rod 28 is rotated through the angle θ (θ=90°) and into an angled configuration for the extension unit 26, a cloth towel 14 can hang clear of any contact with a roll of paper towels 12 being held on the support 16. Also, in order for the extension unit 26 to be received inside the lumen 24 of the tubular support 16, the length $L_u$ of the upper rod 28, plus the length $L_L$ of the lower rod 30 needs to be less than the length H of the support 16 ($L_U$+$L_L$<H). Further, for this same purpose, the diameters $d_r$ of both the upper rod 28 and the lower rod 30 must be less than the inside diameter $d_i$ of the lumen 24 ($d_r$<$d_i$). Additionally, so that the upper rod 28 can be supported in the angled configuration of the extension unit 26, the length s of the prong 32 on the upper rod 28 is preferably less than half the inside diameter $d_i/2$ of the lumen 24 ($s<d_i/2$).

While the particular Cloth Towel Hanger for Use With a Paper Towel Dispenser as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A device for holding towels which comprises:

a tubular support having a first end and a second end, the support defining an axis and being formed with a lumen extending along the axis between the first end and the second end, wherein the support has a length H and an outside diameter $d_o$, and the lumen has an inside diameter $d_i$, wherein the support is mounted on a base for holding a roll of paper towels upright on the base;

a straight upper rod having a first end and a second end, the upper rod having a length $L_u$ between the first end and the second end with a diameter $d_r$, wherein a hanger is attached to the first end of the upper rod and a prong is formed to extend from the second end of the upper rod, and wherein $d_r$ is less than di; and a straight lower rod having a first end and a second end, the lower rod having a length $L_L$ with a diameter $d_r$, wherein a pair of parallel opposed tines are formed onto the first end of the lower rod for receiving the prong of the upper rod therebetween for engagement therewith to establish, in combination, an extension unit having an intermediate pivot point between the upper and lower rods, wherein the extension unit is reconfigurable by a relative rotation of the upper rod and the lower rod about the pivot point between a straight configuration wherein the upper rod is aligned with the lower rod for insertion of the extension unit into the lumen of the support, and an angled configuration when the extension unit is partially withdrawn from the lumen of the support and the upper rod is rotated about the pivot point through an angle θ to extend perpendicular to the axis of the support to orient the hanger at the length $L_u$ from the axis of the support for hanging a cloth towel therefrom.

2. The device recited in claim 1 wherein the base is circular and has a radius R, and wherein the length $L_u$ of the upper rod is greater than R.

3. The device recited in claim 1 wherein the length $L_u$ of the upper rod plus the length $L_L$ of the lower rod is less than the length H of the support.

4. The device recited in claim 1 wherein the prong at the second end of the upper rod has a length s, and wherein s is less than half the inside diameter $d_i/2$ of the lumen.

5. The device recited in claim 1 wherein the angle θ=90°.

6. A device for holding towels which comprises:

a hollow support having a first end and a second end, the support defining an axis and being formed with a lumen extending along the axis, wherein the support is mounted on a base for holding a roll of paper towels upright on the base; and an extension unit, having an upper rod and a lower rod engaged with each other at an intermediate pivot point for relative rotation of the upper and lower rods about the pivot point and with a hanger attached to the upper rod opposite the pivot point, wherein the extension unit is reconfigurable by a relative rotation of the upper rod and the lower rod about the pivot point between a straight configuration wherein the upper rod is aligned with the lower rod for insertion of the extension unit into the lumen of the support, and an angled configuration when the extension unit is partially withdrawn from the lumen of the support and the upper rod is rotated through an angle θ about the pivot point to extend perpendicular to the axis of the support to orient the hanger at the length $L_u$ from the axis of the support for hanging a cloth towel therefrom.

7. The device recited in claim 6 wherein the support has a length H and an outside diameter $d_o$, wherein the lumen of the support has an inside diameter $d_i$, wherein the upper rod has a length $L_u$ and a diameter $d_r$, wherein the prong of the upper rod has a length s, wherein the lower rod has a length $L_L$ with the diameter $d_r$, and wherein the base is circular and has a radius R.

8. The device recited in claim 7, wherein:

the length $L_u$ of the upper rod is greater than R;

the length $L_u$ of the upper rod plus the length $L_L$ of the lower rod is less than the length H of the support;

the length s for the prong of the upper rod is less than half the inside diameter $d_i/2$ of the lumen;

the respective diameters $d_r$ of the upper rod and the lower rod are less than the inside diameter $d_i$ of the lumen of the support; and wherein the angle θ=90°.

* * * * *